US012704035B2

(12) United States Patent
Ramirez et al.

(10) Patent No.: US 12,704,035 B2
(45) Date of Patent: Aug. 11, 2026

(54) ANCHOR SYSTEM, METHOD, AND BOREHOLE SYSTEM

(71) Applicant: Baker Hughes Oilfield Operations LLC, Houston, TX (US)

(72) Inventors: Joseph Ramirez, Houston, TX (US); Stephen Zamora, Pearland, TX (US); Jeffrey Honekamp, Tomball, TX (US); Farhat Shaikh, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 32 days.

(21) Appl. No.: 18/327,105

(22) Filed: Jun. 1, 2023

(65) Prior Publication Data

US 2024/0401424 A1 Dec. 5, 2024

(51) Int. Cl.
*E21B 23/01* (2006.01)
*E21B 33/129* (2006.01)
*E21B 33/134* (2006.01)

(52) U.S. Cl.
CPC ..... *E21B 23/01* (2013.01); *E21B 33/129* (2013.01); *E21B 33/134* (2013.01)

(58) Field of Classification Search
CPC ..... E21B 23/01; E21B 33/134; E21B 33/129; E21B 33/1291; E21B 33/1293
See application file for complete search history.

(56) References Cited

U.S. PATENT DOCUMENTS 2,187,487 A * 1/1940 Burt ..... E21B 33/134 166/126
3,036,639 A * 5/1962 Baker ..... E21B 33/1216 166/134
5,390,737 A * 2/1995 Jacobi ..... E21B 29/00 166/134
6,491,116 B2 * 12/2002 Berscheidt ..... E21B 33/12 175/57
7,475,736 B2 * 1/2009 Lehr ..... E21B 33/129 166/134
8,066,065 B2 * 11/2011 Buckner ..... E21B 33/1293 166/138
11,891,877 B1 * 2/2024 Crews ..... E21B 34/103
(Continued)

OTHER PUBLICATIONS

Notification of Transmittal of the International Search Report and the Written Opinion of the International Searching Authority, or the Declaration; PCT/2024/031215; Mail Date: Sep. 10, 2024; 10 pages.

*Primary Examiner* — Yong-Suk (Philip) Ro
(74) *Attorney, Agent, or Firm* — Baker Hughes Company

(57) ABSTRACT

An anchor system, including a mandrel, a cone disposed upon the mandrel, a slip disposed upon the mandrel and adjacent the cone, and a retainer interactive with the cone, the slip and the mandrel to initially prevent the slip from climbing the cone. A method for operating an anchor system including passing a load through a slip, a retainer in contact with the slip and a cone in contact with the retainer while preventing relative movement between the skip and the cone, moving the slip, retainer, and cone relative to a mandrel having a recess, locating the retainer radially outwardly of the recess, urging the retainer into the recess with the slip and the cone. A borehole system including a borehole in a subsurface formation, a string in the borehole, and an anchor system disposed within or as a part of the string.

14 Claims, 9 Drawing Sheets

(56) References Cited

U.S. PATENT DOCUMENTS

| | | | | |
|---|---|---|---|---|
| 2011/0024134 | A1 | 2/2011 | Buckner | |
| 2017/0342794 | A1 | 11/2017 | Silva et al. | |
| 2018/0045017 | A1 | 2/2018 | Thornton et al. | |
| 2019/0162044 | A1* | 5/2019 | Dirocco | E21B 23/06 |
| 2021/0079756 | A1* | 3/2021 | Ornelaz | E21B 33/1293 |
| 2021/0222511 | A1 | 7/2021 | Burckhard | |
| 2022/0251915 | A1 | 8/2022 | Murphy et al. | |

* cited by examiner

ANCHOR SYSTEM, METHOD, AND BOREHOLE SYSTEM

BACKGROUND

In the resource recovery and fluid sequestration industries there is need for running anchoring systems alone or as a component of other tools such as packer systems. There is also a need to sometimes carry load through slips of the anchoring systems by design or by serendipity. Loads carried through the slips are limited by the shear members that are used to hold the slips in place prior to setting. Sometimes, the load capability of the slips is insufficient and preset occurs, which is undesirable. The art would well receive alternative innovations that avoid preset concerns.

SUMMARY

An embodiment of an anchor system, including a mandrel, a cone disposed upon the mandrel, a slip disposed upon the mandrel and adjacent the cone, and a retainer interactive with the cone, the slip and the mandrel to initially prevent the slip from climbing the cone.

An embodiment of a method for operating an anchor system including passing a load through a slip, a retainer in contact with the slip and a cone in contact with the retainer while preventing relative movement between the skip and the cone, moving the slip, retainer, and cone relative to a mandrel having a recess, locating the retainer radially outwardly of the recess, urging the retainer into the recess with the slip and the cone.

An embodiment of a borehole system including a borehole in a subsurface formation, a string in the borehole, and an anchor system disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
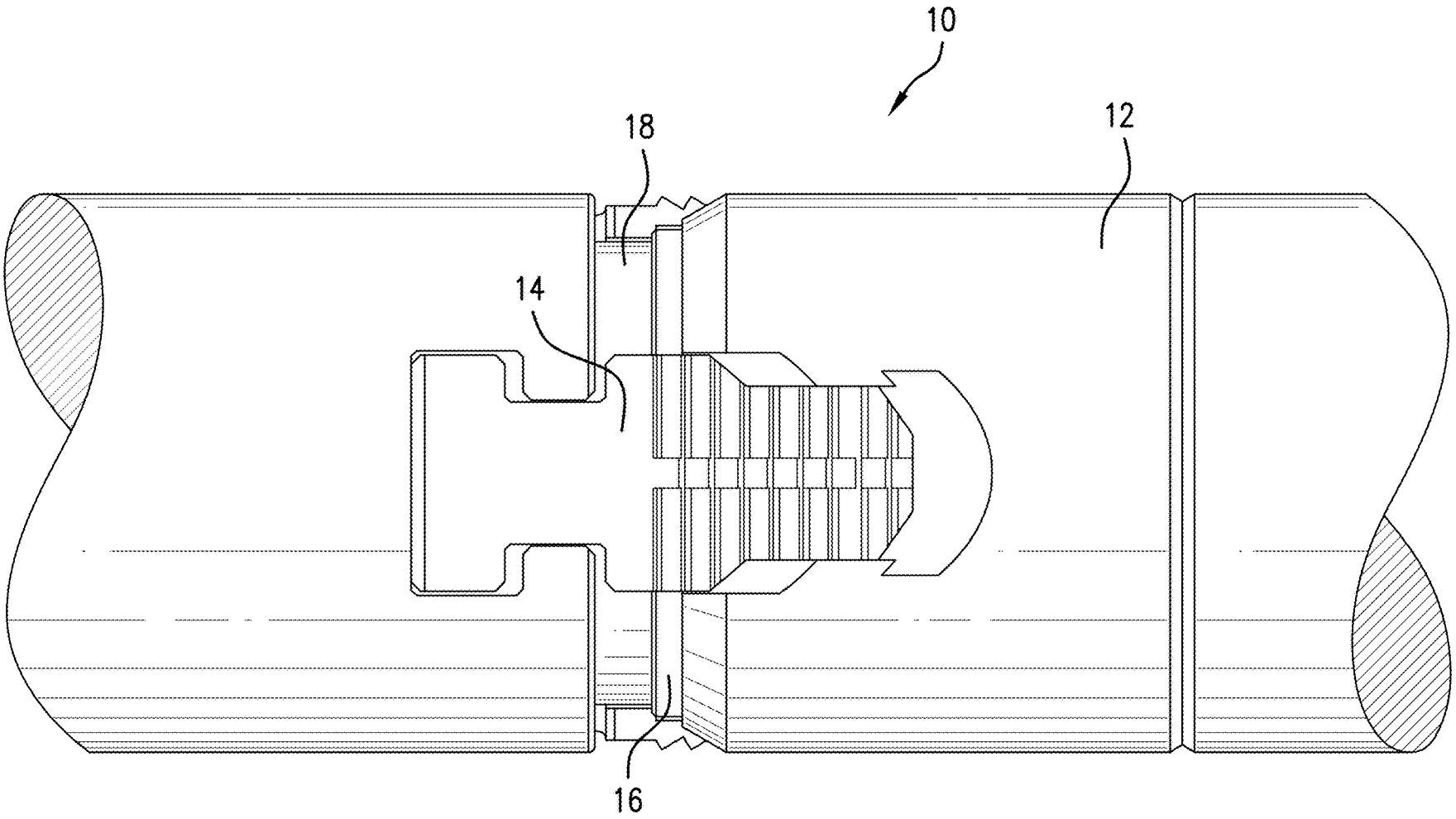
FIG. 1 is a side view of an anchor system as disclosed herein.
Figure 2:
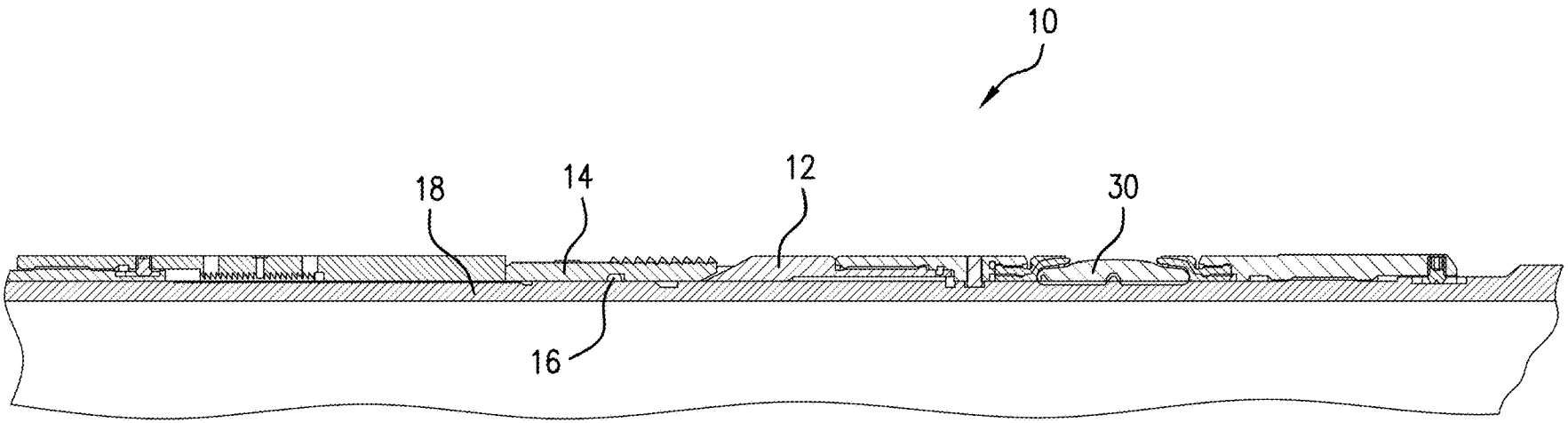
FIG. 2 is a cross sectional view of the system of FIG. 1.
Figure 3:
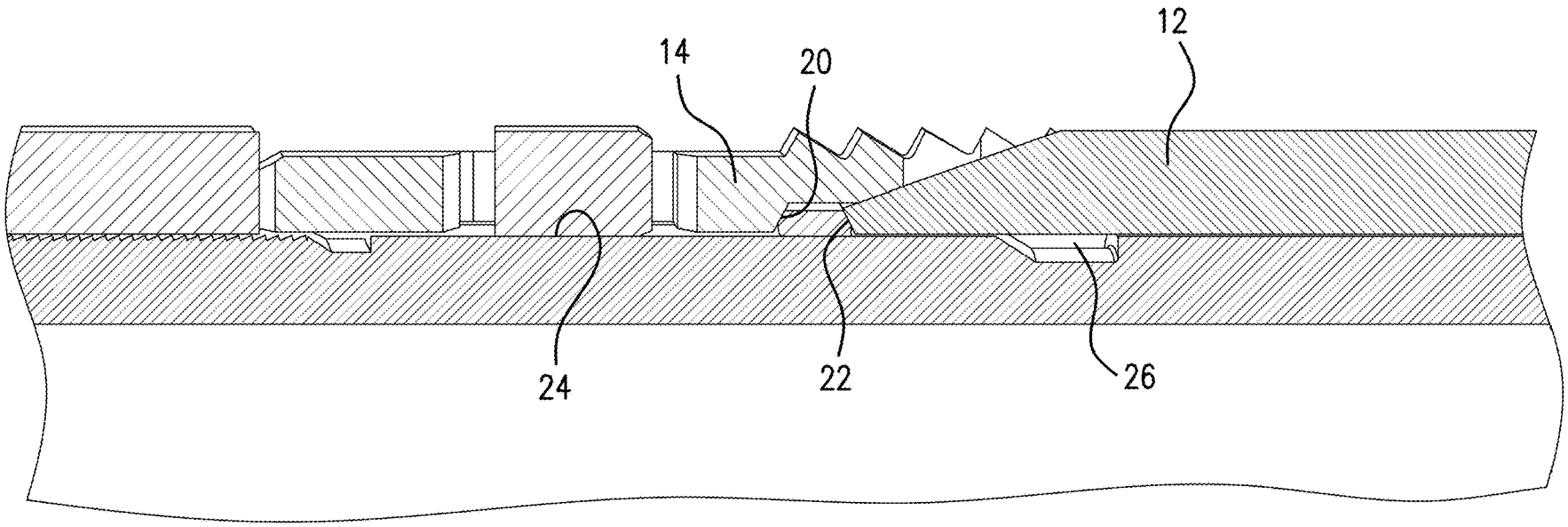
FIG. 3 is an enlarged view of a portion of FIG. 2.

Referring to FIG. 1-5, an anchor system 10 is illustrated. System 10 includes a cone 12, a slip 14 (see FIG. 4) and a retainer 16, such as a radially outwardly biased C ring, (see FIG. 5) disposed upon a mandrel 18. Referring to FIG. 2, a cross section view of FIG. 1 makes the initial run-in positions of the above identified components clearer. FIG. 3 is an enlarged view of a portion of FIG. 2. In FIG. 3, still in the run-in position, it is easy to appreciate that slip 14 is prevented from climbing the cone 12 by the retainer 16. This is because the retainer 16 is physically blocking the movement of the slip 14 to climb the cone 12 and thereby move radially outwardly. The retainer 14 is trapped between shoulder 20 of slip 14, stop 22 of cone 12 and a surface 24 of the mandrel 18. So long as the mandrel surface 24 remains in contact with the retainer 16, the slip remains locked against travel up the cone 12. In order to permit setting when setting is appropriate, i.e., not a preset situation, the mandrel 18 is provided with a recess 26. Recess 26 is dimensioned to receive the retainer 16 and is positioned along the mandrel 18 so that any needed stroke prior to setting may be obtained without a load through the slip 14 causing a preset. In one embodiment, the position of the recess 26 will allow movement of the slip and cone in a direction to the right of the figure an amount equal to the amount of stroke needed to expand a packer (or set or actuate some other tool) attached to the anchor system 10. At the end of the prescribed stroke, the retainer 16 will be positioned radially outwardly of the recess 26 and forced by the slip 14 and the cone 12 to move radially inwardly into the recess 26, thereby releasing the slip 14 to move up the cone 12. It will be appreciated from FIG. 3 that shoulder 20 and stop 22 are both angled toward the mandrel 18 so that when the mandrel surface 24 is no longer an impediment to movement of the retainer 16 radially inwardly, the angles of the shoulder 20 and stop 22 will naturally urge the retainer 16 into the recess 26. Angles contemplated include about 60 to about 75 degrees. Retainer 16 may in some embodiments have chamfered edges that approximate the angles of the shoulder 20 and the stop 22 to reduce frictional resistance to the retainer 16 moving radially inwardly into the recess 26.

Figure 4:
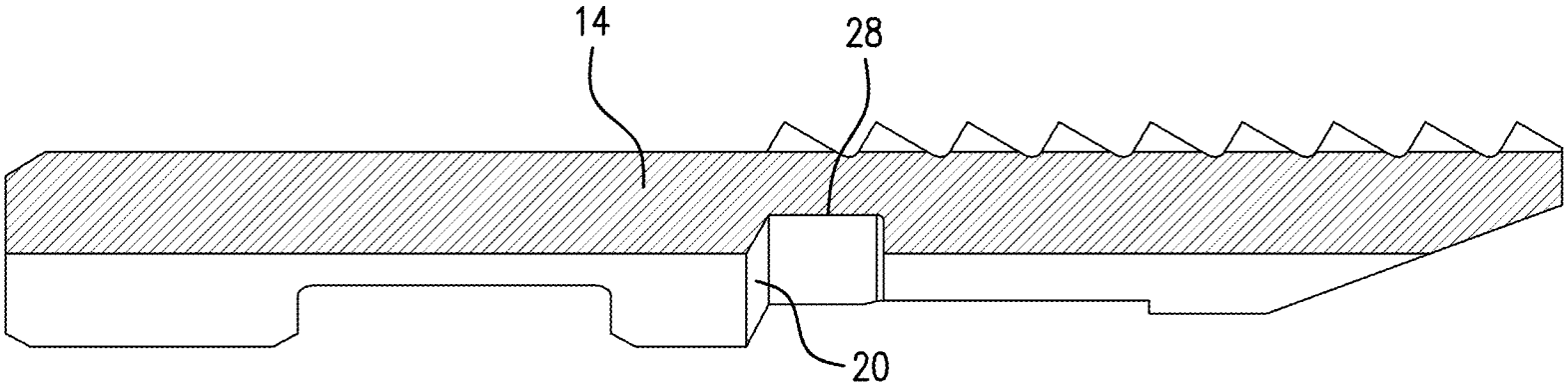
FIG. 4 is an enlarged cross-sectional view of a slip of the system of FIG. 1.
Figure 5:
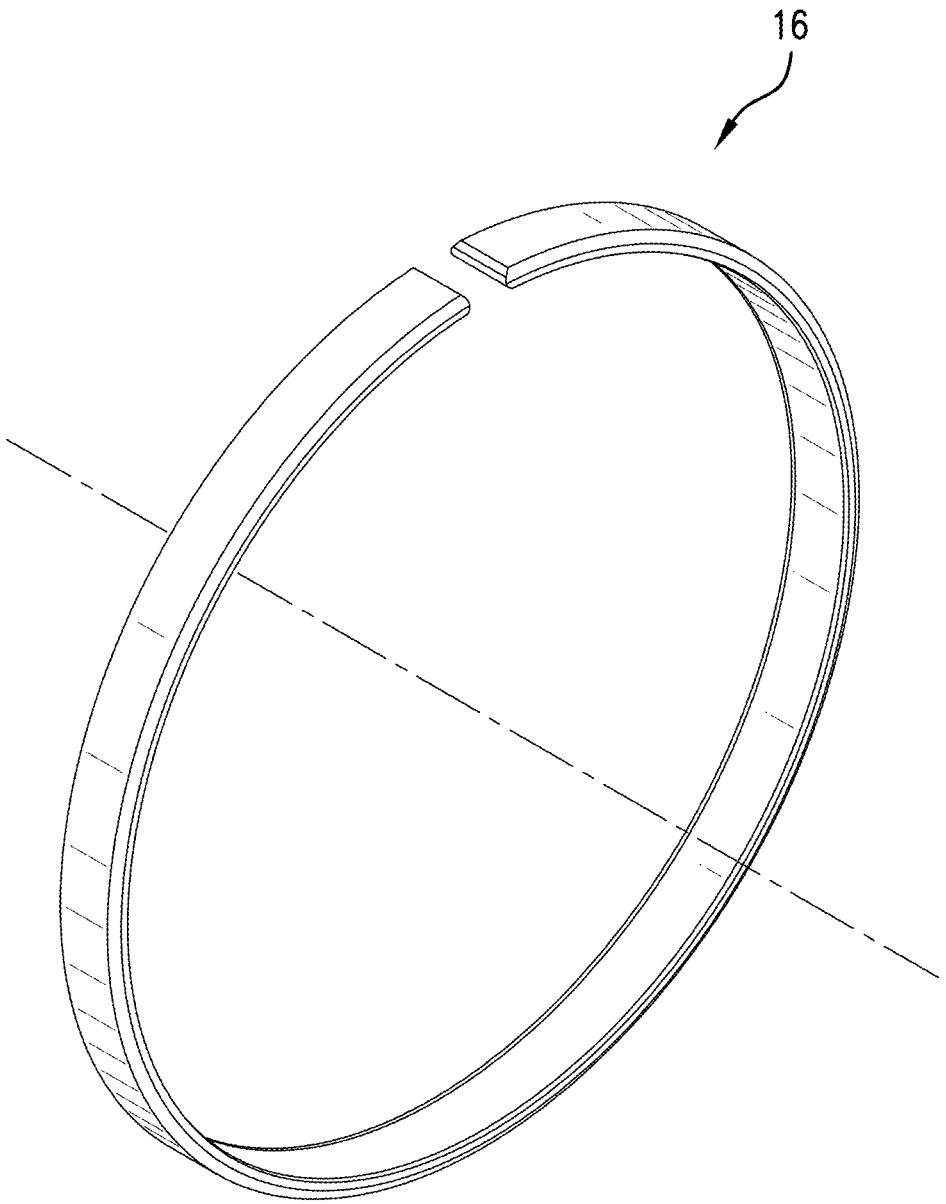
FIG. 5 is a perspective view of a retention ring of the system of FIG. 1.

Referring to FIG. 4, while it is to be appreciated that the shoulder 20 is the operative feature with regard to moving the retainer 16 as described above, the provision of the shoulder 20 may be by way of a change in thickness of the slip 14 that would create the shoulder 20 or by way of a groove 28 in the material of the slip 14 as is easily appreciable in FIG. 4.

Figure 6:
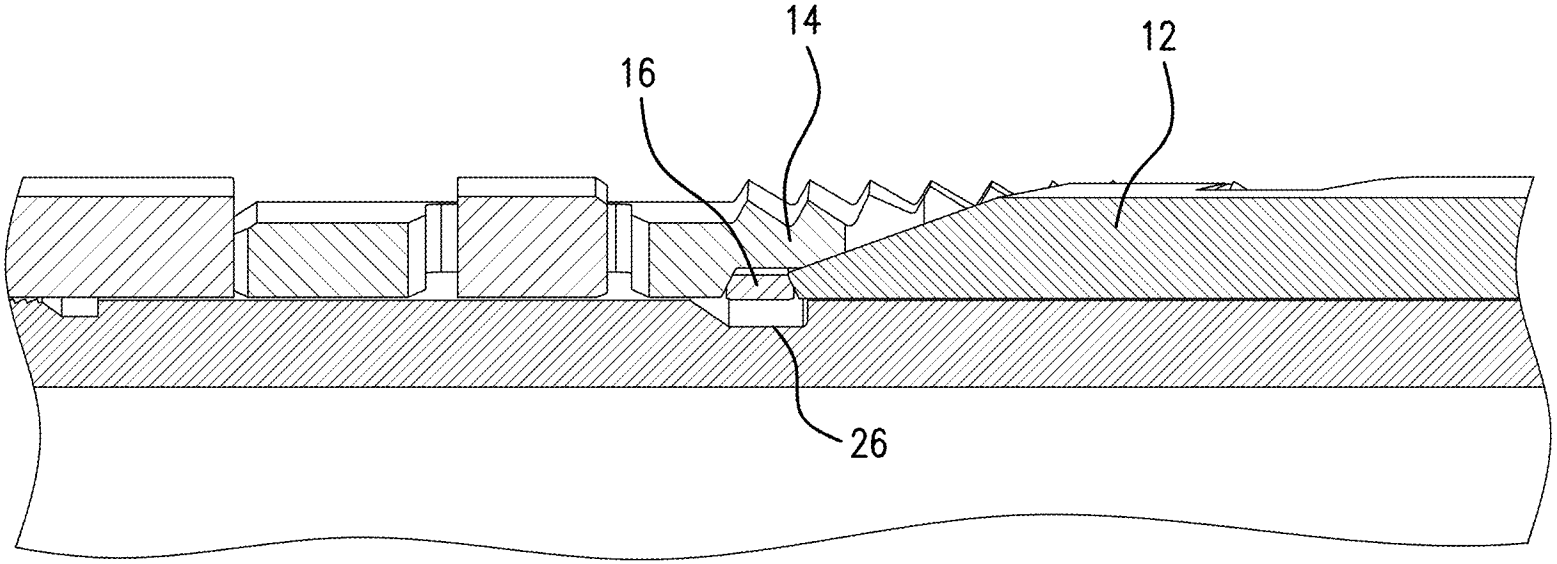
FIGS. 6-8 are sequential sectional views of the system illustrating operation thereof.
Figure 7:
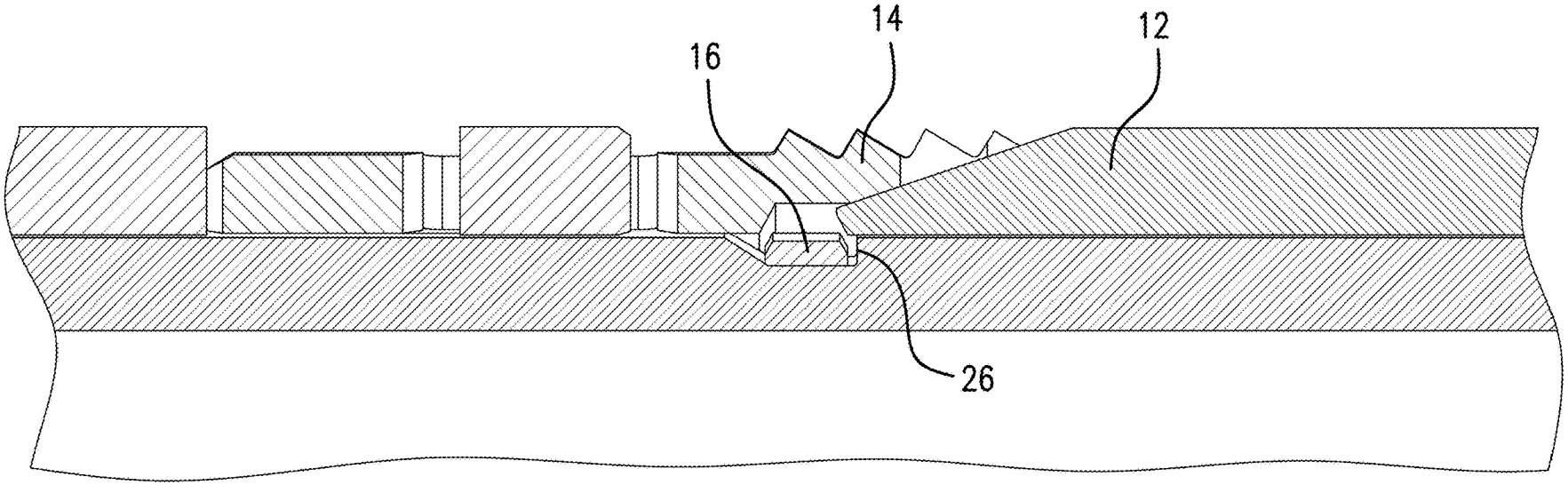
Figure 8:
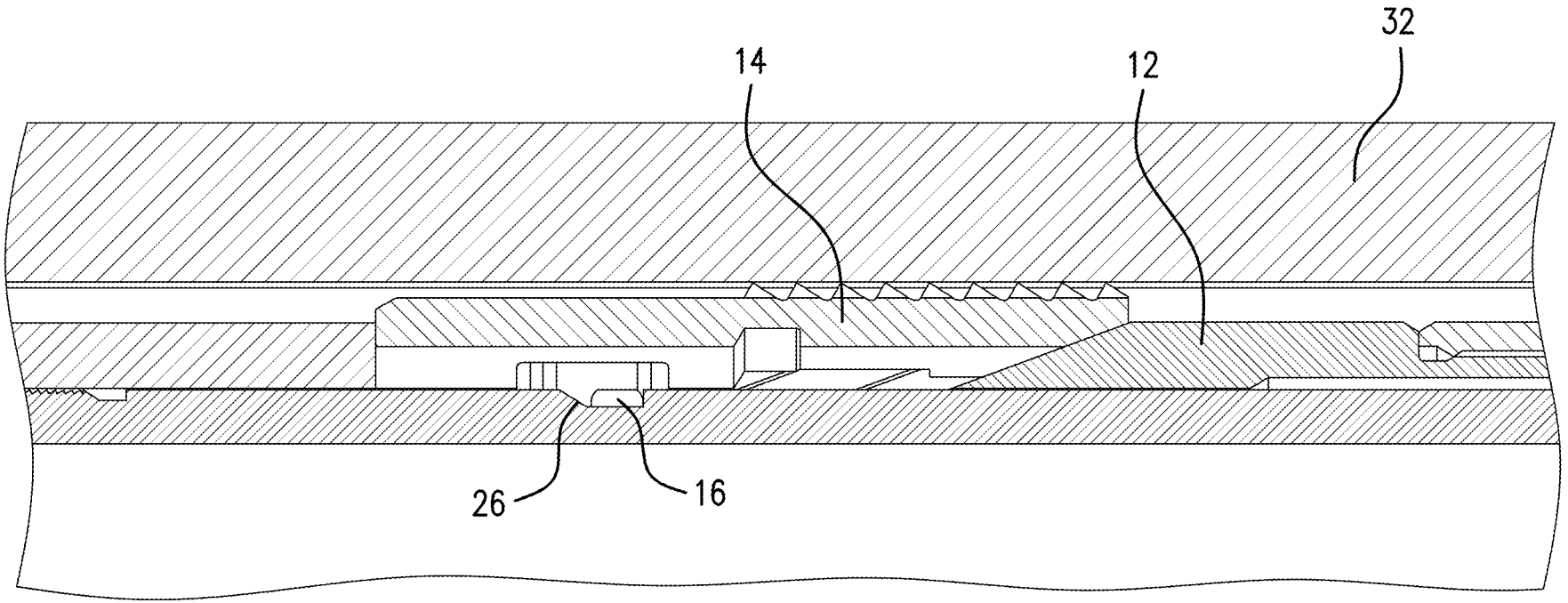

Referring to FIGS. 3 and 6-8, the sequence of events in operation of the system 10 is illustrated. FIG. 3 illustrates the components in a run-in position as discussed above. Retainer 16 is to the left in the Figure or uphole of the recess 26 in mandrel 18. In FIG. 6, the cone 12, the slip 14, and the retainer 16 have moved to the right of the figure relative to the mandrel 18, or in the downhole direction, to position the retainer 16 radially outwardly of the recess 26. This movement is associated with stroke needed to set another tool such as a packer 30 (FIG. 2) associated with the anchor system 10. With the cone 12 stroked it will resist further movement and the slip 14 will continue to input energy to the retainer 16. The retainer 16 at this point in the operation is being pinched between the non-moving cone 12 at the stop 22 and the shoulder 20. The angles on shoulder 20 and stop 22 as noted above impart a radial input to the retainer 16 and hence continued inching will push the retainer 16 into recess 26 as illustrated in FIG. 7. Once retainer 16 is clear of the shoulder 20, the slip is free to move further downhole and clime the cone 12, thereby being radially displaced into contact with a casing 32 or open hole.

Figure 9:
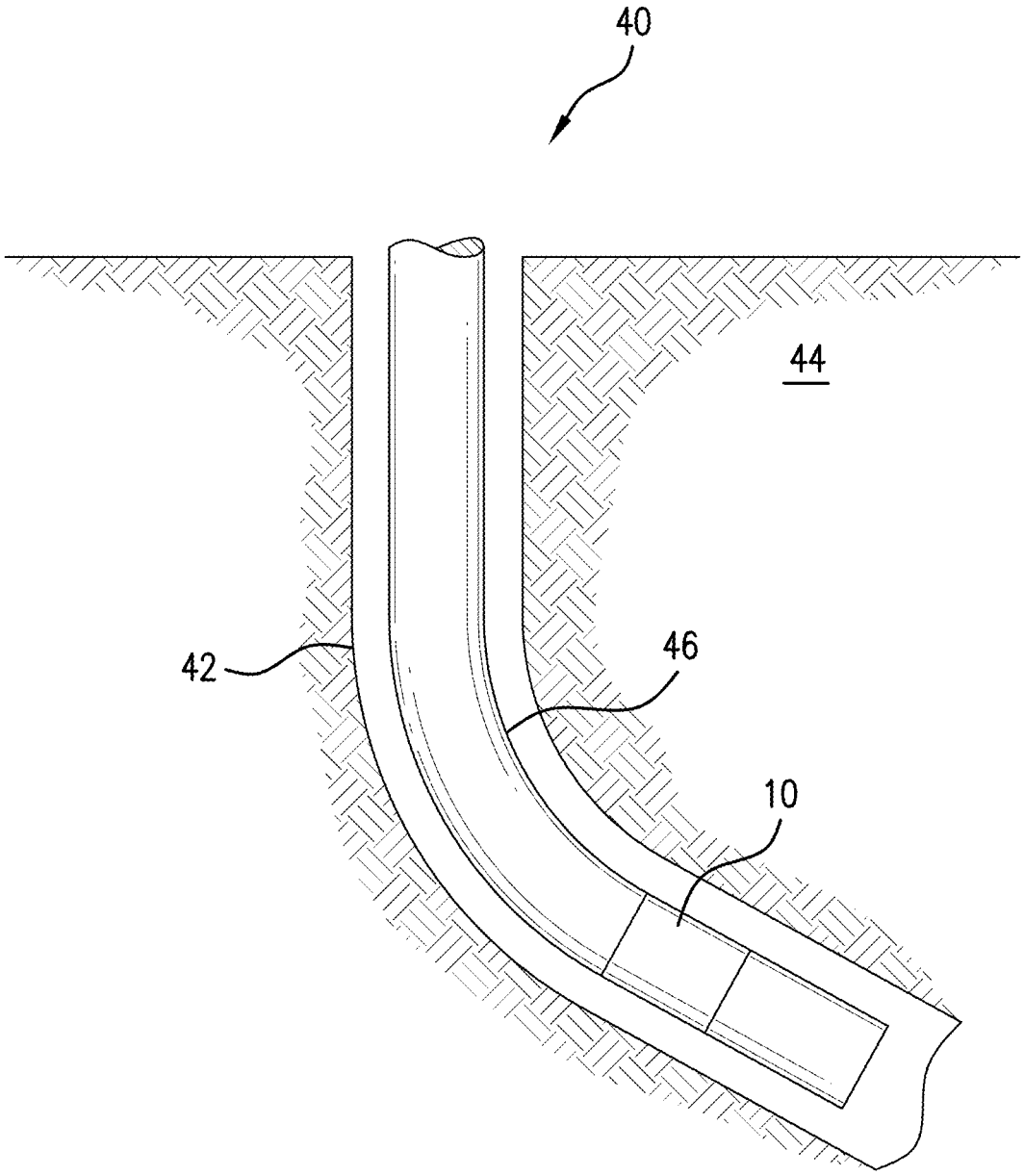
FIG. 9 is a view of a borehole system including an anchor system as disclosed herein.

Referring to FIG. 9, a borehole system 40 is illustrated. The system 40 comprises a borehole 42 in a subsurface formation 44. A string 46 is disposed within the borehole 42. An anchor system 10 as disclosed herein is disposed within or as a part of the string 46. It will be appreciated that in some embodiments the string 46 is the casing 32 while in others the string 46 is being run inside the casing 32 (See FIG. 8).

Set forth below are some embodiments of the foregoing disclosure:

Embodiment 1: An anchor system, including a mandrel, a cone disposed upon the mandrel, a slip disposed upon the mandrel and adjacent the cone, and a retainer interactive with the cone, the slip and the mandrel to initially prevent the slip from climbing the cone.

Embodiment 2: The system as in any prior embodiment, wherein the mandrel further includes a recess therein, the recess receptive of at least a portion of the retainer.

Embodiment 3: The system as in any prior embodiment, wherein the recess is receptive of the radial thickness of the retainer.

Embodiment 4: The system as in any prior embodiment, wherein the cone includes a stop, initially in contact with the retainer.

Embodiment 5: The system as in any prior embodiment, wherein the stop is angled with an acute angle toward a surface of the mandrel.

Embodiment 6: The system as in any prior embodiment, wherein the slip includes a shoulder initially in contact with the retainer.

Embodiment 7: The system as in any prior embodiment, wherein the shoulder is angled with an acute angle toward a surface of the mandrel.

Embodiment 8: The system as in any prior embodiment, wherein the retainer includes chamfers.

Embodiment 9: The system as in any prior embodiment, wherein the retainer is responsive to load placed thereupon by a shoulder of the slip and a stop of the cone when the retainer is located radially outwardly and in line with a recess in the mandrel.

Embodiment 10: The system as in any prior embodiment, wherein the shoulder is a part of a groove in the slip.

Embodiment 11: A method for operating an anchor system including passing a load through a slip, a retainer in contact with the slip and a cone in contact with the retainer while preventing relative movement between the slip and the cone, moving the slip, retainer, and cone relative to a mandrel having a recess, locating the retainer radially outwardly of the recess, urging the retainer into the recess with the slip and the cone.

Embodiment 12: The method as in any prior embodiment, wherein the moving is by a stroke length of another tool associated with the anchor system.

Embodiment 13: The method as in any prior embodiment, wherein the urging is by pinching the retainer between the cone and the slip.

Embodiment 14: The method as in any prior embodiment, further comprising urging the slip to climb the cone after the retainer is disposed in the recess.

Embodiment 15: A borehole system including a borehole in a subsurface formation, a string in the borehole, and an anchor system as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor system, comprising:

a mandrel having a radially outward surface and a recess in the radially outward surface;

a cone disposed upon the mandrel;

a slip disposed upon the mandrel and adjacent the cone; and a retainer initially in direct contact with the cone and the slip, the retainer being radially inwardly disposed of the slip and inaccessible from radially outwardly of the slip when in the initial position, the retainer being axially adjacent one end of the cone, the retainer initially positioned on the radially outward surface of the mandrel to initially prevent the slip from climbing the cone and only during deployment the retainer being received in the recess.

2. The system as claimed in claim 1, wherein the mandrel further includes a recess therein, the recess receptive of at least a portion of the retainer.

3. The system as claimed in claim 1, wherein the recess is receptive of the radial thickness of the retainer.

4. The system as claimed in claim 1, wherein the cone includes a stop, initially in contact with the retainer.

5. The system as claimed in claim 4, wherein the stop is angled with an acute angle toward a surface of the mandrel.

6. The system as claimed in claim 1, wherein the slip includes a shoulder initially in contact with the retainer.

7. The system as claimed in claim 6, wherein the shoulder is angled with an acute angle toward a surface of the mandrel.

8. The system as claimed in claim 1, wherein the retainer includes chamfers.

9. The system as claimed in claim 1, wherein the retainer is radially responsive to load placed thereupon by a shoulder of the slip and a stop of the cone when the retainer is located radially outwardly and in line with a recess in the mandrel.

10. The system as claimed in claim 9, wherein the shoulder is a part of a groove in the slip.

11. A method for operating an anchor system comprising;

passing a load through a) a slip having a shoulder, b) a retainer in contact with the slip shoulder, and c) a cone having a stop that is in contact with the retainer, the retainer preventing relative movement between the slip and the cone;

moving the slip, retainer, and cone together relative to a mandrel having a recess, until the retainer is positioned radially outwardly of the recess in the mandrel;

reducing a distance between the slip shoulder and the cone stop and simultaneously forcing the retainer into the recess; and radially outwardly displacing the slip on the cone.

12. The method as claimed in claim 11, wherein the moving is by a stroke length of another tool associated with the anchor system.

13. The method as claimed in claim 11, wherein the forcing is by pinching the retainer between the cone and the slip.

14. A borehole system comprising:

a borehole in a subsurface formation;

a string in the borehole; and an anchor system as claimed in claim 1 disposed within or as a part of the string.

* * * * *